US009587611B2

(12) United States Patent
Ganser

(10) Patent No.: US 9,587,611 B2
(45) Date of Patent: Mar. 7, 2017

(54) FUEL INJECTION VALVE AND DEVICE FOR INJECTING FUEL

(71) Applicant: GANSER-HYDROMAG AG, Oberägeri (CH)

(72) Inventor: Marco Ganser, Oberägeri (CH)

(73) Assignee: GANSER-HYDROMAG AG (CH)

( * ) Notice: Subject to any disclaimer, the term of this patent is extended or adjusted under 35 U.S.C. 154(b) by 144 days.

(21) Appl. No.: 14/373,430

(22) PCT Filed: Feb. 1, 2013

(86) PCT No.: PCT/EP2013/000318
§ 371 (c)(1),
(2) Date: Jul. 21, 2014

(87) PCT Pub. No.: WO2013/117311
PCT Pub. Date: Aug. 15, 2013

(65) Prior Publication Data

US 2014/0360469 A1 Dec. 11, 2014

(30) Foreign Application Priority Data

Feb. 7, 2012 (CH) ..... 0174/12

(51) Int. Cl.
*F02M 69/04* (2006.01)
*F02M 67/12* (2006.01)
(Continued)

(52) U.S. Cl.
CPC ..... *F02M 67/12* (2013.01); *F02M 55/001* (2013.01); *F02M 55/005* (2013.01); *F02M 55/02* (2013.01); *F02M 55/008* (2013.01)

(58) Field of Classification Search
CPC ..... F02M 37/0023; F02M 43/04; F02M 63/0225; F02M 2200/40; F02M 51/06;
(Continued)

(56) References Cited

U.S. PATENT DOCUMENTS 1,157,315 A * 10/1915 Lemp ..... F02M 61/165 239/86
1,625,606 A * 4/1927 Reinhard ..... F02M 67/12 239/408
(Continued)

FOREIGN PATENT DOCUMENTS

CH 702 496 B1 7/2011
DE 10 2005 012928 A1 9/2006
(Continued)

OTHER PUBLICATIONS

International Search Report for PCT/EP2013/000318 mailed on Mar. 19, 2013.
(Continued)

*Primary Examiner* — Marguerite McMahon
*Assistant Examiner* — Tea Holbrook
(74) *Attorney, Agent, or Firm* — Hershkovitz & Associates, PLLC; Abe Hershkovitz

(57) ABSTRACT

The fuel injection valve (1) for the intermittent injection of fuel into the combustion chamber of an internal combustion engine has a valve housing (12) that defines a longitudinal axis (14) and is provided with a high-pressure chamber (16). The connecting part (20) of the valve housing (12) has two identically formed high-pressure connections (22, 24) for high-pressure fuel lines. The two identically formed high-pressure connections (22, 24) are arranged in a common connecting face (30') in such a way that said high-pressure connections are oriented in the same direction and the connection axes (22', 24') thereof run parallel to each other. In the interior of the valve housing (12), the high-pressure connections (22, 24) are connected to each other and to the high-pressure chamber (16).

19 Claims, 6 Drawing Sheets

(51) Int. Cl.
*F02M 55/00* (2006.01)
*F02M 55/02* (2006.01)

(58) Field of Classification Search
CPC ..... F02M 63/005; F02M 63/0078; F02M 55/002; F02M 55/008; F02M 55/025; F02M 21/0251; F02M 2200/502
USPC .... 123/445, 468, 469, 457, 461; 239/86, 87, 239/88
See application file for complete search history.

(56) References Cited

U.S. PATENT DOCUMENTS 3,930,483 A 1/1976 Blisko et al.
4,185,779 A * 1/1980 Watson ..... F02M 59/105 123/472
4,569,484 A * 2/1986 Phatak ..... B05B 7/0416 239/408
4,782,794 A * 11/1988 Hsu ..... F02D 19/04 123/23
5,467,754 A * 11/1995 Beck ..... F02M 47/02 123/300
6,152,112 A 11/2000 Coppola
6,276,336 B1 * 8/2001 Kruger ..... F02M 55/025 123/456
8,336,524 B2 * 12/2012 Ganser ..... F02M 55/025 123/456
2003/0121994 A1 * 7/2003 Yudanov ..... F02M 65/005 239/533.9
2004/0045537 A1 * 3/2004 Simon ..... F02M 39/005 123/495
2004/0168673 A1 * 9/2004 Shinogle ..... F02M 45/04 123/456
2004/0184878 A1 9/2004 Eberle
2006/0151637 A1 * 7/2006 Schneider ..... F02M 47/027 239/533.2
2008/0184962 A1 8/2008 Pauer
2008/0203347 A1 * 8/2008 Burrola ..... F02M 55/04 251/284
2008/0296413 A1 12/2008 Ganser
2009/0065614 A1 3/2009 Ganser
2009/0199820 A1 * 8/2009 Geyer ..... F02M 55/025 123/447
2010/0013219 A1 1/2010 Hlousek
2010/0170476 A1 * 7/2010 Ganser ..... F02M 55/025 123/447
2010/0244434 A1 * 9/2010 Okuno ..... F16L 37/101 285/24
2010/0294243 A1 11/2010 Ganser
2011/0271935 A1 11/2011 Pirkl
2011/0315118 A1 * 12/2011 Coldren ..... F02M 53/043 123/456
2013/0092131 A1 * 4/2013 Graspeuntner ..... F02M 55/005 123/456
2013/0160741 A1 * 6/2013 Sommars ..... F02M 43/04 123/456
2014/0000562 A1 * 1/2014 Eklund ..... F02M 55/002 123/447

FOREIGN PATENT DOCUMENTS

DE 10 2007 039893 A1 2/2009
DE WO 2011085858 A1 * 7/2011 ..... F02M 55/02
FI WO 2012107633 A2 * 8/2012 ..... F02M 55/002
WO WO 03/076794 A1 9/2003
WO WO 2006/010182 A1 2/2006
WO WO 2007/009279 A1 1/2007
WO WO 2007/098621 A1 9/2007
WO WO 2008/046238 A2 4/2008
WO WO 2009/033304 A1 3/2009
WO WO 2011/085058 A1 7/2011
WO WO 2011/085858 A1 7/2011

OTHER PUBLICATIONS

International Preliminary Report on Patentability for PCT/EP2013/000318 mailed on Aug. 21, 2014.

* cited by examiner

FUEL INJECTION VALVE AND DEVICE FOR INJECTING FUEL

The present invention relates to an injection valve for the intermittent injection of fuel into the combustion chamber of an internal combustion engine as per claim 1, and to a device for the intermittent injection of fuel into a number of combustion chambers of an internal combustion engine, as per claim 14.

A fuel injection valve is known from document WO 2009/033304 A1. Said fuel injection valve has a valve housing which defines a longitudinal axis and which delimits a high-pressure chamber and which, on one end, bears a nozzle body that is connected to the high-pressure chamber. A housing body that forms the valve housing is of thickened form, in the manner of a head, in its end region facing away from the nozzle body and has two high-pressure ports situated diametrically opposite one another with respect to the longitudinal axis (FIG. 8). A bore that runs in the direction of the longitudinal axis is closed off by means of a sealing plug, which sealing plug has an encircling connecting groove, a radial bore that opens out in the base region of said connecting groove, and a blind bore situated on the longitudinal axis. The two high-pressure ports are connected to one another via the connecting groove, and the high-pressure ports are connected to the high-pressure chamber via the radial bore and the blind bore.

A such design of the fuel injection valve allows to connect a series of such fuel injection valves to one another by means of fuel high-pressure connecting lines and to connect a first of the series of fuel injection valves to a high-pressure delivery pump via a fuel high-pressure feed line. Such a device for the intermittent injection of fuel into combustion chambers of an internal combustion engine has the advantage that cumbersome and expensive so-called common rails can be dispensed with, and it is nevertheless possible, with a space-saving construction, to ensure reliable operation of the injection valves. A way of achieving this in a particularly simple manner emerges from documents WO 2007/009279 A1 and WO 2009/033304 A1.

Document WO 2011/085058 A1 discloses a fuel injection device which has a high-pressure inlet, a first fuel injection valve and at least one further fuel injection valve. Here, the fuel can be conducted at least indirectly into a fuel chamber of the first fuel injection valve via the high-pressure inlet, wherein the further fuel injection valve is connected to the first fuel injection valve via a line and wherein, via the lines, fuel can be conducted from the fuel chamber of the first fuel injection valve into a fuel chamber of the further fuel injection valve. For the damping of pressure pulsations, the fuel chambers of the fuel injection valves accommodate an overall fuel volume that comprises a sub-volume for fuel injection and at least one additional sub-volume for permitting the damping. Furthermore, throttles are installed in the lines or high-pressure ports of the fuel injection valves.

It is an object of the present invention to provide a fuel injection valve for the intermittent injection of fuel into the combustion chamber of an internal combustion engine and a device for the intermittent injection of fuel into a number of combustion chambers of an internal combustion engine, in such a way that high-pressure fuel lines can be formed, and connected to the fuel injection valve or to the fuel injection valves, in a particularly simple manner.

Said object is achieved by means of a fuel injection valve having the features of claim 1 and by means of a device having the features of claim 14.

The fuel injection valve according to the invention for the intermittent injection of fuel into the combustion chamber of an internal combustion engine has a preferably elongate, and preferably at least approximately cylindrical, valve housing which defines a longitudinal axis and in which there is arranged a high-pressure chamber that has a discrete accumulator chamber. Said high-pressure chamber extends into the interior of a nozzle body which is arranged on, and borne by, a longitudinal end of the valve housing. The valve housing, in an end region facing away from the nozzle body, has a port part with two high-pressure ports. Said high-pressure ports define their respective port axis and are connected in terms of flow to one another in unthrottled fashion and also to the high-pressure port.

According to the invention, the two high-pressure ports are arranged in a common port surface of the port part, wherein said high-pressure ports are oriented in the same direction and their port axes run parallel to one another.

In other words, high-pressure fuel lines can be connected to the two high-pressure ports from the same side.

It is preferable for a connecting line to be provided which is formed in the valve housing and which connects the high-pressure ports to one another and to the high-pressure chamber. A first section of the connecting line leads from the first high-pressure port to the high-pressure chamber. A second section of the connecting line branches off from the first section and connects said first section to the second high-pressure port. In this way, the high-pressure ports are connected to one another via a line and not via the high-pressure chamber.

In a preferred embodiment, the port surface is a port plane. This permits a particularly simple design.

It is particularly preferable for said port plane to run perpendicular to the longitudinal axis of the fuel injection valve. The high-pressure ports are thus—in the installed state—situated on a side of the fuel injection valve which faces away from the cylinder head of the internal combustion engine and which is thus freely accessible. The port plane particularly preferably forms a face side of the valve housing.

In a further preferred embodiment, the port axes of the two high-pressure ports and the longitudinal axis of the valve housing are parallel to one another.

In a further preferred embodiment, the longitudinal axis and the port axis lie in a common plane, wherein the longitudinal axis and one of the port axes are particularly preferably in alignment with one another.

A particularly simple design both of the fuel injection valve and also of the high-pressure fuel lines is realized if the high-pressure ports are of identical design.

The high-pressure ports normally have, concentrically with respect to the port axis, a high-pressure sealing surface, which preferably tapers conically toward the housing interior, for the high-pressure fuel lines.

In certain fields of use for fuel injection valves according to the invention, in particular when said fuel injection valves are used in marine engines, it may be necessary to perform leakage monitoring. For this purpose, the high-pressure ports have, outside the high-pressure sealing surfaces as viewed in the radial direction, leakage monitoring openings that are connected in terms of flow to one another in the port part. In these situations, the high-pressure fuel lines are of double-walled form, with the inner pipe serving to conduct the highly pressurized fuel, and the jacket space between the inner pipe and the outer pipe serving for leakage monitoring. Then, in the installed state, the jacket space is connected in terms of flow to the leakage monitoring openings, and the inner pipe then bears sealingly by way of its sealing surface against the high-pressure sealing surface.

In a preferred embodiment of the fuel injection valve, the nozzle body has an injection valve seat which is connected in terms of flow to the high-pressure chamber. Nozzle openings that lead through the nozzle body are situated, in a known manner, in the region of the injection valve seat or, in the center thereof, in a nozzle tip. An injection valve element which is in particular of needle-like form interacts with the injection valve seat, said injection valve element being arranged in the valve housing so as to be adjustable in the direction of the longitudinal axis. A compression spring is supported on the injection valve element and exerts on the latter a closing force directed toward the injection valve seat. At the other side, the compression spring is supported on a guide sleeve and presses the latter sealingly against an intermediate plate. The guide sleeve, together with a control piston which is guided in the guide sleeve and formed on the injection valve element, delimits a control chamber with respect to the high-pressure chamber. A control device for controlling the axial movement of the injection valve element by varying the pressure in the control chamber has an intermediate valve whose intermediate valve element, when in an open position, opens up a high-pressure passage, connected to the high-pressure chamber, into the control chamber and, when in a closed position, separates the control chamber from the high-pressure passage. Furthermore, the intermediate valve element, which is preferably of mushroom-shaped form, permanently separates the control chamber from a valve chamber, wherein the control chamber and the valve chamber are permanently connected to one another only via a throttle passage. By means of an electrically controlled actuator arrangement, a pilot valve is actuated which connects the valve chamber to, and separates the latter from, a low-pressure fuel return line.

The control device is preferably designed as disclosed in document WO 2007/098621 A1.

The actuator arrangement is preferably designed as is known from document WO 2008/046238 A2.

The relevant disclosure in said documents is hereby incorporated by reference into the present description.

In a further preferred embodiment, the high-pressure chamber includes a discrete accumulator chamber. This makes it possible for the pressure drop during the injection processes to be kept within limits.

Furthermore, a throttle device is preferably provided which permits the flow of the fuel from the high-pressure ports into the accumulator chamber in at least approximately unhindered fashion and throttles said flow in the opposite direction. This makes it possible for highly pressurized fuel to flow to each fuel injection valve, during its injection process, both from the discrete accumulator chamber of other fuel injection valves and also from a high-pressure delivery device (high-pressure delivery pump). In this regard, explicit reference is made to document WO 2007/009279 A1, which discloses the construction and mode of operation and also the dimensioning of such fuel injection valves and discrete accumulator chambers (and the interaction thereof with the high-pressure fuel lines). The relevant disclosure is hereby incorporated by reference into the present description.

The throttle device is preferably in the form of a check valve, the check valve element of which is provided with a throttle bore.

In a further preferred embodiment, the port part has, or is formed by, a port body. The high-pressure ports and the connecting line are formed on the port body, wherein the connecting line connects the high-pressure ports in unthrottled fashion to one another and to the discrete accumulator chamber which is formed in an accumulator body, which bears against the port body, of the valve housing. It is furthermore preferable for a low-pressure fuel return line port—which is connected to the low-pressure fuel return line—and an electrical terminal to be arranged on the port body, said electrical terminal being connected via an electrical connecting line to the actuator arrangement. It is furthermore preferable for an intermediate body in which the actuator arrangement is arranged to bear against the accumulator body. Moreover, it is preferable for a valve body of the valve housing to bear against the intermediate body, which valve body, on the side facing away from the intermediate body, bears the nozzle body. The injection valve element and the control device are arranged in the valve housing.

Said bodies preferably bear against one another in succession in the direction of the longitudinal axis and are preferably fastened to one another by means of cap nuts.

Said bodies preferably have an at least approximately circular cylindrical outer contour, wherein this may decrease in diameter (in stepped fashion) from the intermediate body to the nozzle body.

It is preferable for the valve housing, in particular the port body, to have at least one fastening flange that projects outwardly in a radial direction. In particular, two diametrically oppositely situated fastening flanges are provided. The fastening flange, or fastening flanges, is or are preferably provided with a passage hole. For the purpose of fastening the fuel injection valve to the cylinder head of the internal combustion engine, the passage hole is extended through by a clamping screw which is then supported by way of its head on the respective fastening flange and, at the other side, is screwed into the cylinder head.

It is particularly preferable for the fastening flange or the fastening flanges to be arranged, as viewed in the direction of the longitudinal axis, between the port part and the nozzle body, in particular on a leg, which runs in the direction of the longitudinal axis, of the port body.

The device according to the invention for the intermittent injection of fuel into a number of combustion chambers of an internal combustion engine has a fuel injection valve according to the invention for each combustion chamber. The fuel injection valves are of structurally identical form. A first high-pressure fuel line—a fuel high-pressure feed line—is connected to a first of the two high-pressure ports of a first of said fuel injection valves, which first high-pressure fuel line, for feeding highly pressurized fuel to the fuel injection valves, is connected at the other side to a high-pressure delivery pump. A second high-pressure fuel line is connected to a second of the two high-pressure ports of said first fuel injection valve, which second high-pressure fuel line is connected at the other side to the first high-pressure port of the two high-pressure ports of the subsequent fuel injection valve. Said second high-pressure fuel line forms a fuel high-pressure connecting line. The fuel injection valves are connected in terms of flow to one another in unthrottled fashion and preferably also to the high-pressure delivery pump in unthrottled fashion.

If only two fuel injection valves are provided, the second high-pressure port of the second fuel injection valve is closed off by means of a plug.

However, if at least one further fuel injection valve is provided, then there is connected to the second high-pressure port of the second injection valve a further second high-pressure fuel line, which in turn is connected, by way of its other end, to the first high-pressure port of the subsequent injection valve. In this way, a number of fuel injection valves can be fed in unthrottled fashion via the high-pressure fuel lines, wherein, in the case of the last of the row of injection valves, the second high-pressure port is closed off by means of a plug.

In a device of said type, it is possible firstly for all of the fuel injection valves to be of structurally identical form, and these can be fed with highly pressurized fuel in unthrottled fashion in a simple manner. It is possible to dispense with a large accumulator volume, known as a "common rail". For this purpose, each fuel injection valve preferably has a discrete accumulator chamber and a throttle device such as are described further above. The mode of operation, design possibilities and dimensioning for permitting optimum injection processes under all operating conditions are disclosed in document WO 2007/009279 A1.

In a particularly preferred embodiment, the second high-pressure fuel line or the second high-pressure fuel lines is or are provided with bends situated in one plane, that is to say the central line of the second high-pressure fuel line lies in the plane. Such high-pressure fuel lines can be produced in a simple manner, and this is made possible by virtue of the fact that the injection valves of structurally identical form are arranged parallel to one another and the high-pressure ports thereof lie in the common port surface, preferably in the port plane.

In one particularly preferred embodiment, all of the second high-pressure fuel lines—that is to say the central lines thereof—lie in a single plane, and the longitudinal axes of the fuel injection valves, and the port axes thereof, particularly preferably lie in the same single plane as the second high-pressure fuel lines. If the fuel injection valves are arranged equidistantly, all of the second high-pressure fuel lines can be of structurally identical form.

The present invention will be explained in more detail on the basis of an exemplary embodiment illustrated in the drawing, in which, merely in schematic form in each case:

Figure 1:
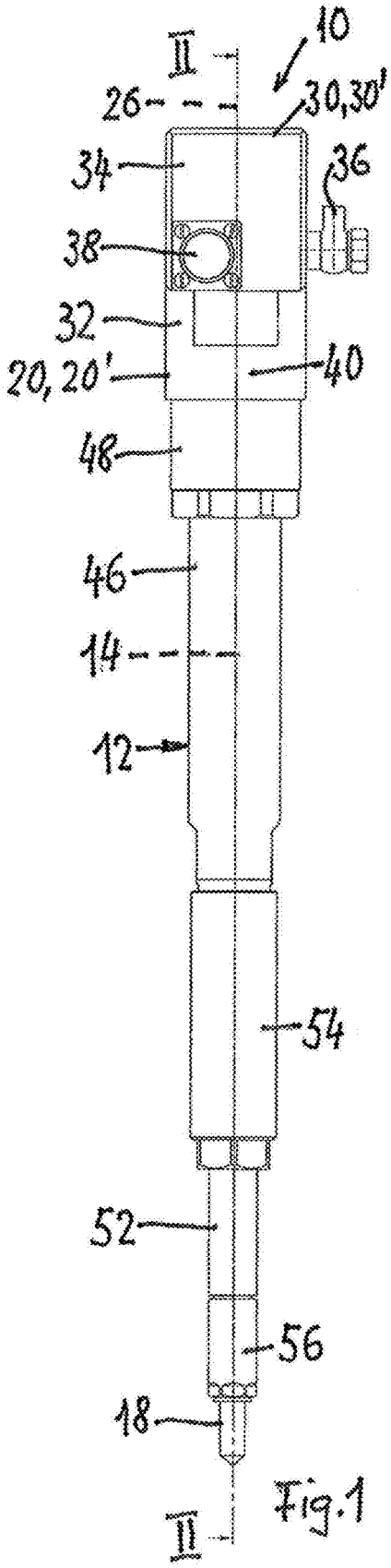
FIG. 1 shows a view of a fuel injection valve according to the invention.

The fuel injection valve illustrated in the drawing and the illustrated device having injection valves of said type are provided for an ignition system for large reciprocating-piston engines that are operated with gas and/or diesel, and also so-called "dual fuel" engines. Since these are very high-powered engines, the injectors may have a large structural length, as illustrated in the drawing. The injection valves serve, so to speak, as pilot valves for the ignition of the main fuel charge. Injection valves and devices of the type according to the invention may however also be used—in the case of engines of lower power—for the injection of the main charge.

Figure 2:
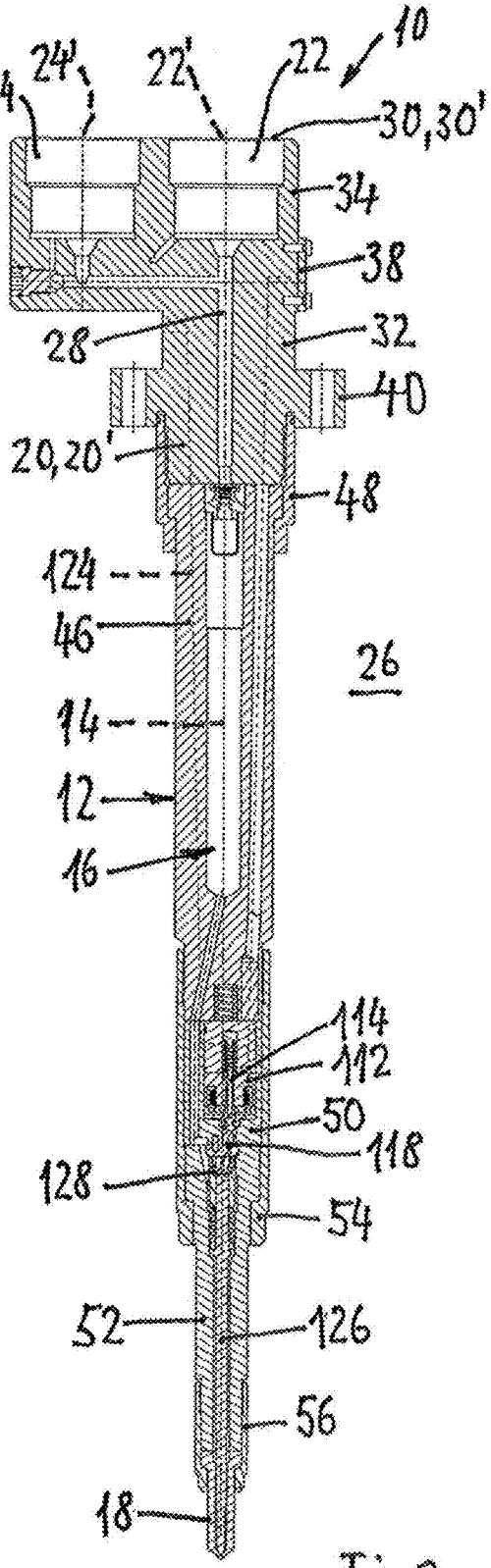
FIG. 2 shows the injection valve as per FIG. 1 in a section along the line II-II in FIG. 1.

As can be seen from FIGS. 1 and 2, the fuel injection valve 10 according to the invention for the intermittent injection of highly pressurized fuel into the combustion chamber of an internal combustion engine has a valve housing 12 which defines a longitudinal axis 14 and in which a high-pressure chamber 16 is provided.

At its injection-side end, the valve housing 12 bears a nozzle body 18 which delimits a nozzle chamber that is connected to the high-pressure chamber 16.

In the end region facing away from the nozzle body 18 as viewed in the direction of the longitudinal axis 14, the valve housing 12 has a port part 20 which forms a port head 20' of the fuel injection valve 10. In the exemplary embodiment shown, the port part 20 is formed by a port body 20'.

Two high-pressure ports 22, 24 of identical form are formed integrally on the port part 20 or port head 20', which high-pressure ports define a respective port axis 22' and 24'. The two high-pressure ports 22, 24 are oriented in the same direction, and their port axes 22', 24' run parallel to one another.

In the exemplary embodiment shown, the port axis 22' of the first high-pressure port 22 is in alignment with the longitudinal axis 14; the latter and the two port axes 22' and 24' lie in a common plane 26 which coincides with the section plane II-II in FIG. 1 and with the plane of the drawing of FIG. 2.

The two high-pressure ports 22, 24 are connected to one another in unthrottled fashion and to the high-pressure chamber 16 by means of a connecting line 28 formed on the port part 20, specifically in the port head 20'.

A first section 28' of the connecting line 28 connects the first high-pressure port 22 to the high-pressure chamber 16. A second section 28" of the connecting line branches off from said first section 28', which second section leads to the second high-pressure port 24. The connecting line 28 has no throttles; the high-pressure ports 22, 24 are likewise formed without throttles.

The two high-pressure ports 22 and 24 are formed in a port surface 30' which, in the present case, forms a port plane 30 and which, as viewed in the direction of the longitudinal axis 14, forms the face side of the valve housing 12. In the exemplary embodiment shown, the port plane 30 runs perpendicular to the longitudinal axis 14, and thus also perpendicular to the port axes 22', 24'.

In the exemplary embodiment shown, the port body 20' that forms the port part 20 is of L-shaped form, wherein the leg 32 that runs in the direction of the longitudinal axis 14 has a circular cross section, and the port leg 34 that runs perpendicular thereto is of cuboidal form; said port leg forms the port head 20'.

A low-pressure fuel return port 36 is arranged on a side surface of the port leg 34, and an electrical terminal 38 formed in the manner of a plug socket is situated on a side surface running perpendicular to the former side surface.

Fastening flanges 40 project outwardly from the leg 32 in a radial direction diametrically opposite one another, the passage holes 40' of which fastening flanges are designed to be extended through by clamping screws 40" by means of which the fuel injection valve is fastened to a cylinder head 42 (see FIG. 5) of the internal combustion engine 44.

A circular cylindrical accumulator body 46 bears against that face side of the leg 32, and thus of the port body 22', which faces away from the high-pressure ports 22, 24, said accumulator body being held in sealing abutment by means of a first cap nut 48. The accumulator body 46 forms a part of the valve housing 12.

An intermediate body 50 of the valve housing 12 bears against that face side of the accumulator body 46 which faces away from the port body 20'. The outer contour of said intermediate body is of circular cylindrical form.

A valve body 52 bears against that side of the intermediate body 50 which faces away from the accumulator body 46. Said valve body is engaged on by a second cap nut 54 which surrounds the intermediate body 50 and, at the other end, is screwed into an external thread of the accumulator body 46. By means of the second cap nut 54, the valve body 52 is held in sealing abutment on the intermediate body 50, and the latter is held in sealing abutment on the accumulator body 46.

The nozzle body 18 bears against the free end of the valve body 52, said nozzle body in turn being sealingly fastened to the valve body 52 by means of a third cap nut 56.

For the sake of completeness, it is pointed out that the central axes of the accumulator body 46, of the intermediate body 50, of the valve body 52 and of the nozzle body 18 lie in the longitudinal axis 14.

Figure 3:
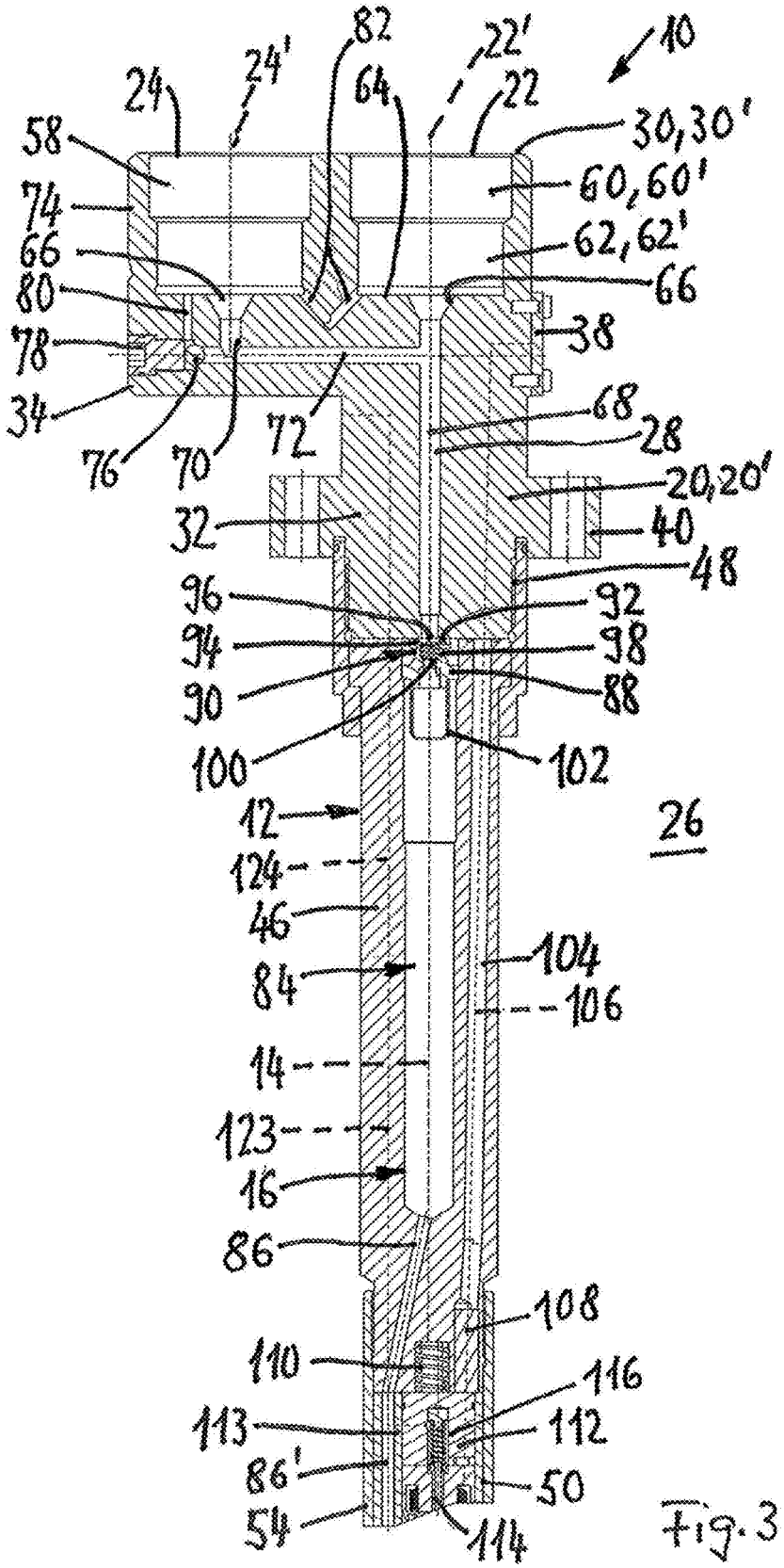
FIG. 3 shows, in an illustration similar to FIG. 2 but on an enlarged scale, a first section of the fuel injection valve.

As can be seen from FIGS. 2 and 3, the two high-pressure ports 22, 24 are formed by recesses 58 of circular cross section, and concentric with respect to the respective port axes 22', 24', in the port body 20'.

The high-pressure ports 22, 24, or the recesses 58 that form these, have a circular cylindrical first section that adjoins the port plane 30 via a bevel. The jacket wall of said first section 60 serves as a low-pressure sealing surface 60', as will be explained further below in conjunction with FIGS. 7 to 10.

The first section 60 is followed, in the direction of the interior of the port body 20', by a conically tapering shoulder which is adjoined by a circular cylindrical second section 62. The jacket wall of said second section 62 is formed as an internal thread 62'.

The planar base, running perpendicular to the respective port axis 22', 24', of the recess 58 is denoted by 64.

Furthermore, each of the two high-pressure ports 22, 24 has a conically tapering high-pressure sealing surface 66 proceeding from the base 64, the axis of which high-pressure sealing surface coincides with the respective port axis 22', 24'. A longitudinal bore 68 runs, concentrically with respect to the port axis 22' and longitudinal axis 14, from the high-pressure sealing surface 66 of the first high-pressure port 22 through the nozzle body 18 to the face side, facing away from the high-pressure ports 22, 24, of said nozzle body.

A blind bore 70 runs in the direction of the port axis 24' from the high-pressure sealing surface 66 of the second high-pressure port 24, which blind bore opens into a transverse bore 72, which in turn opens into the longitudinal bore 68.

The transverse bore 72 runs perpendicular to the longitudinal axis 14 and the port axes 22', 24' and in the plane 26. Said transverse bore is formed as far as the longitudinal bore 68 proceeding from that side surface 74 of the port leg 34 which is situated closest to the second high-pressure port 24, wherein, in an end region adjoining the side surface 74, said transverse bore has a relatively large cross section and is formed so as to taper in a stepped manner. At the internal end of said end region there is arranged a sealing ball 76 which, by means of a pressure-exerting plug 78 which is screwed into and sealed in the end region, is held so as to seal off the transverse bore 72 with respect to high pressures. For this purpose, the transverse bore 72 may have, adjoining the end region, a conically tapering sealing surface against which the sealing ball 76 is pressed.

The connecting line 28 mentioned further above is formed by a section 68', which leads from the high-pressure port 22 to the high-pressure chamber 16, of the longitudinal bore 68 (corresponding to the first line section 28'), by the blind bore 70 and by the transverse bore 72 (corresponding to the second line section 28").

From an annular chamber which runs around the sealing ball 76 on the side facing toward the pressure-exerting plug 78, a longitudinal leakage bore 80 runs, parallel to the port axis 24', to the base 64 of the second high-pressure port 24, where said longitudinal leakage bore opens into the recess 58 outside the respective high-pressure sealing surface 66 as viewed in the radial direction, and forms a leakage monitoring opening there.

Furthermore, oblique leakage bores 82 run from the bases 64 of the recesses 58 of the two high-pressure ports 22, 24 proceeding from the sides facing one another, which oblique leakage bores open into one another. For the sake of completeness, it is pointed out that the locations at which the oblique leakage bores 82 open into the high-pressure ports are situated outside the high-pressure sealing surfaces 66 as viewed in the radial direction, and likewise form leakage monitoring openings.

It is pointed out at this juncture that leakage bores such as the longitudinal leakage bore 80 and oblique leakage bores 82 are not required if leakage monitoring is omitted. The mode of operation of the leakage monitoring will be explained in more detail further below in conjunction with FIGS. 7 to 10. In the exemplary embodiment shown, the longitudinal leakage bore 80 serves for the monitoring of the sealing of the connecting line 28 by means of the sealing ball 76.

The accumulator body 46 has a blind bore which is manufactured proceeding from that face side which faces toward the port body 20' in the assembled state, which blind bore has a diameter that is larger in relation to the cross section of the connecting line. In the exemplary embodiment shown, said diameter amounts to approximately one third of the outer diameter of the circular cylindrical accumulator body 46. The blind bore serves for forming a discrete accumulator chamber 84 for the highly pressurized fuel. A connecting bore runs, obliquely with respect to the longitudinal axis 14, to the base of the accumulator chamber 84 from that face side of the accumulator body 46 which faces away from the port body 20'.

In an end section facing toward the port body 20', the blind bore has a larger diameter for the purpose of supporting a shoulder for supporting a valve carrier 88 of a check valve 90. The check valve seat 92 is formed by an annular part, running around the point at which the connecting line 28 opens out, of that face side of the port body 20' which faces toward the accumulator body 46. A check valve body 94 which is of plate-shaped form interacts with the check valve seat 92, which check valve body has a continuous throttle bore 96 centrally, on the longitudinal axis 14.

The check valve body 94 is, by means of a closing spring 98 which is in the form of a compression spring and which is supported at the other end on the valve carrier 88, subjected to a closing force directed toward a closed position of the check valve 90.

A passage 100 of at least approximately the same cross section as the connecting line 28 runs centrally through the valve carrier 88. The valve carrier 88 otherwise closes off the accumulator chamber 84 in the axial direction toward the port body 20'.

The check valve 90, which forms a throttle device, permits the flow of highly pressurized fuel from the high-pressure ports 22, 24 into the accumulator chamber in at least approximately unhindered fashion, and throttles the flow in the opposite direction.

Figure 6:
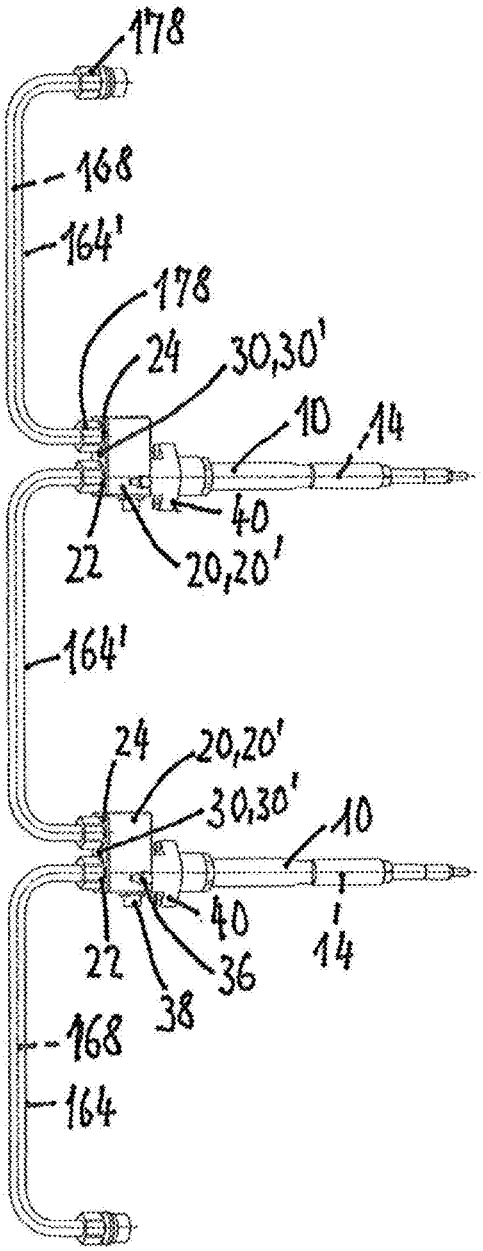
FIG. 6 shows a view of the fuel injection valves and the high-pressure fuel lines as per FIG. 5, without the cylinder head.
Figure 5:
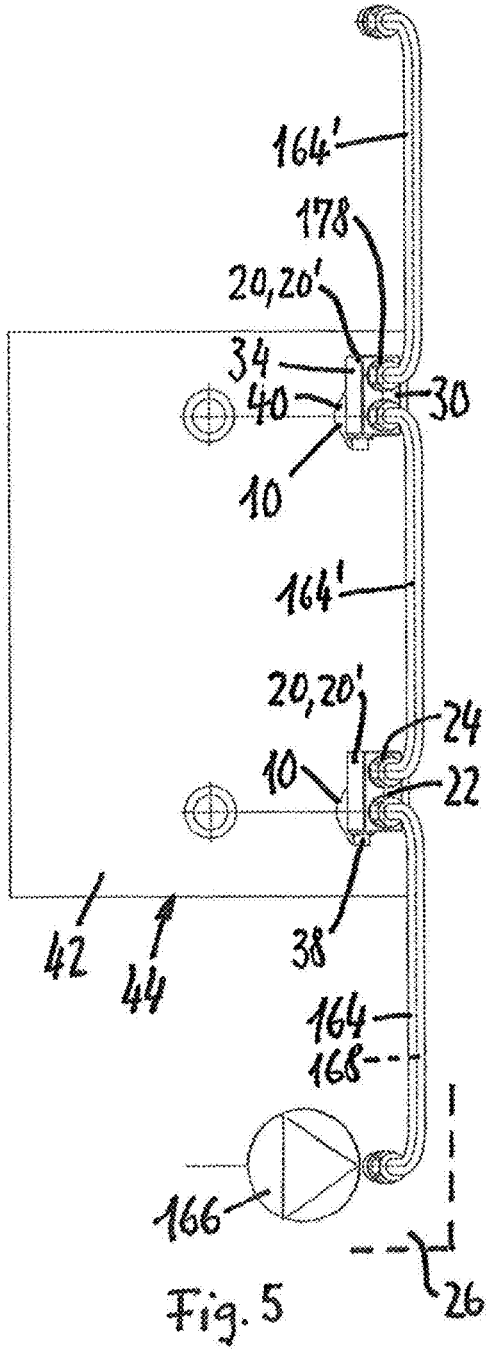
FIG. 5 shows, in a plan view, a cylinder head that is common to two combustion chambers of an internal combustion engine, in which cylinder head an injection valve as shown in FIGS. 1 to 4 is installed for each combustion chamber, and also high-pressure fuel lines.

If multiple fuel injection valves 10 are connected to one another and to a fuel high-pressure pump 166 by means of high-pressure fuel lines 164, 164', as is shown in FIGS. 5 and 6 and described in more detail further below, the throttling action of the check valve 90 is configured such that highly pressurized fuel flows to each fuel injection valve 10 from the accumulator chambers 86 of other fuel injection valves 10, from the fuel high-pressure lines 164, 164' and from the high-pressure delivery device 166 during an injection process. This mode of operation is described in detail in document WO 2007/009279 A1 and also in document WO 2009/033304 A1. Explicit reference is made to said documents.

Furthermore, a filter 102, in the present case a cup-shaped perforated filter, is fastened to the valve carrier 88, which filter projects into the interior of the accumulator chamber 84 from the valve carrier 88 and into which the passage 100 through the valve carrier 88 opens out. The filter 102 and the check valve 90 may be designed differently; preferred embodiments emerge from document WO 2009/033304 A1.

The filter 102 prevents solid particles from passing into the high-pressure chamber 16 and possibly impairing the function of the fuel injection valve 10.

Furthermore, a duct 104 runs in the longitudinal direction through that wall of the accumulator body 46 which delimits the accumulator chamber 84. A corresponding duct is also formed in the port body 20', which corresponding duct is in alignment with the duct 104 and leads to the electrical terminal 38. An electrical control line 106 leads from said electrical terminal through the duct 104 in the port body 20' and in the accumulator body 46 to terminal contacts 108 which, in the assembled state, project into the duct 104.

The accumulator body 46 finally has a recess which is open toward that face side which faces away from the port body 20' and toward the intermediate body 50, in which recess there is arranged a compression spring 110. Said compression spring serves for holding down an electrically controlled actuator arrangement 112 in a corresponding recess in the intermediate body 50. The actuator arrangement 112 is electrically connected to the terminal contacts 108 and, via the latter and the electrical control line 106, to the electrical terminal 38.

Such actuator arrangements 112 are generally known, and the actuator arrangement in the present case is designed as shown and described in detail in FIG. 5 of document WO 2008/046238 A2. The differently designed actuator arrangements disclosed in the cited document may also be used in the present fuel injection valve 10. With regard to construction and mode of operation, reference is explicitly made to document WO 2008/046238 A.

Figure 4:
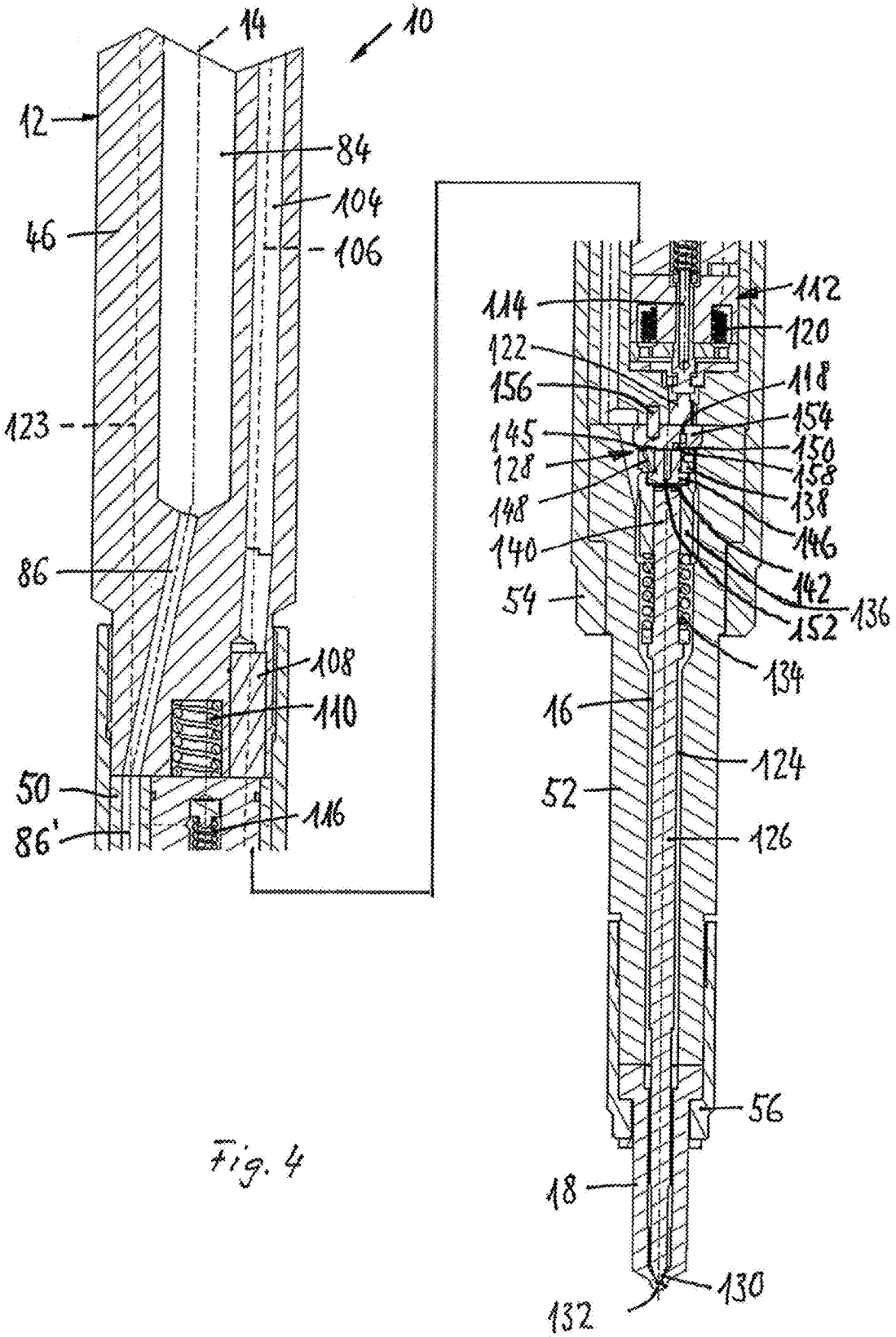
FIG. 4 shows, in an illustration similar to FIG. 2 but on an enlarged scale, a second section of the fuel injection valve.

In the exemplary embodiment shown in FIGS. 2, 3 and 4, the actuator arrangement 112 is received in an actuator receiving recess 113 of the intermediate body 50, which actuator receiving recess is arranged so as to be laterally offset with respect to the longitudinal axis 14. This provides space for a further connecting bore 86' which is connected in terms of flow to the connecting bore 86 and which runs through the intermediate body 50 parallel to the longitudinal axis 14.

The actuator arrangement 112 has an actuating shank 114 which is preloaded in the closing direction of a pilot valve 118 by means of an actuator spring 116 and which can be moved counter to the force of the actuator spring 116, in the opening direction of the pilot valve 118, by means of an electromagnet 120. The electromagnet 120 is activated by an electrical controller which transmits the control signals to the electrical terminal 38.

A passage runs through the intermediate body 50 from the base of the actuator receiving recess 113 of said intermediate body, in which passage a pilot valve element 122 is received so as to be displaceable in the axial direction. Said pilot valve element is actuated by means of the actuating shank 114.

From the base region of the actuator receiving recess 113, a low-pressure fuel return line 123 indicated by dashed lines runs through the intermediate body 50, and then through the accumulator body 46 and the port body 20', to the low-pressure fuel return port 36. The fuel that flows out when the pilot valve 118 is open is thus conducted to a fuel return collecting tank, as is generally known.

As illustrated in particular in FIG. 4, the valve body 52 has a valve body recess 124, which valve body recess is of circular cross section, has multiple steps, is continuous in the axial direction and is concentric with respect to said valve body, and in which valve body recess there are received, in a known manner, a needle-shaped injection valve element 126, the latter being received so as to be displaceable in the axial direction, and a hydraulic control device 128 for controlling the movement of the injection valve element 126.

The injection valve element 126 projects into the cup-shaped nozzle body 18 and, in the latter, interacts in a known manner with an injection valve seat 130 in order to connect continuous nozzle openings 132 to, and separate the latter from, the high-pressure chamber 16. For the sake of completeness, it is pointed out that a gap is present between the injection valve element 126 and the valve body 52 and the nozzle body 18, in order that the highly pressurized fuel can flow to the injection valve seat 130 and to the nozzle openings 132 with low losses.

In a known manner, a compression spring 134 is supported at one side on the injection valve element 126 and subjects the latter to a closing force directed toward the injection valve seat 130. At the other side, the compression spring 134 is supported on a guide sleeve 136 which is thereby pressed sealingly against an intermediate plate 138.

In this end region, the injection valve element is in the form of a control piston 140 which is guided with a tight clearance fit in the guide sleeve 136. The control piston together with the guide sleeve delimits a control arm 142 with respect to the high-pressure chamber 16.

In the exemplary embodiment shown, the needle-shaped injection valve element 122 is guided at one side on the guide sleeve 136 and at the other side, by means of radially projecting guide lips, on the nozzle body 18.

To control the movement of the injection valve element 126 in the axial direction, the pressure in the control chamber 142 is varied by means of a hydraulic control device 128.

The control device 128 has an intermediate valve 145 with an intermediate valve element 146, which intermediate valve element, when in an open position, opens up a high-pressure passage 148 which is formed on the intermediate plate 138 and which leads from the high-pressure chamber 16 into the control chamber 142, and when a closed position, closes said high-pressure passage so as to separate the control chamber 142 from the high-pressure chamber 116.

Furthermore, the intermediate valve element 146 permanently separates the control chamber 142 from a valve chamber 150, aside from a throttle passage 152 via which the control chamber 142 is permanently connected to the valve chamber 150 via a small flow cross section.

In the exemplary embodiment shown, the intermediate valve element 146 is of mushroom-shaped form, wherein the stem is guided with a clearance fit in a passage of the intermediate plate 138, and the mushroom head arranged in the control chamber 142 bears, when in a closed position, against the intermediate plate 138 so as to close off the opening-out point, which is arranged in said region, of the high-pressure passage 148. When the mushroom head is raised from the intermediate plate 138, the fuel can flow through between said intermediate plate and the guide sleeve 136 and into the control chamber 142.

On the side facing away from the control chamber 142, the intermediate plate 138 bears sealingly against a further intermediate plate 154, which further intermediate plate is held in a predefined rotational position in the valve housing 112 by means of a positioning pin 156 and, together with the intermediate plate 138 and the intermediate valve element 146 or the mushroom stem thereof, delimits the valve chamber 150.

In alignment with the axis of the actuator arrangement 112, the further intermediate plate 154 has an outlet passage 158 which is designed so as to taper in a stepped manner from the valve chamber 150 in the direction of the actuator arrangement 112.

The outlet passage 158 can be closed, and opened up to the low-pressure fuel return line 123, by means of the pilot valve element 122 that is controlled by the actuator arrangement 112. The further intermediate plate 154, by way of an annular region running around the opening-out point of the outlet passage 158, forms a pilot valve seat of the pilot valve 118, which pilot valve seat interacts with the pilot valve element 122.

The detailed construction and mode of operation of fuel injection valves 10 having a control device 128 of said type, with the pilot valve 118 and the actuator arrangement 112, are described in detail in documents WO 2007/098621 A and WO 2008/046238 A. The other embodiments disclosed in said documents can likewise be used in the fuel injection valve 10 according to the invention.

FIG. 5 shows a part of a device for the intermittent injection of fuel into a number of combustion chambers of an internal combustion engine 44. Of said device, FIG. 5 shows only a cylinder head 42, which is assigned two combustion chambers. In a known manner, the cylinder head 42 has, for each combustion chamber, a fuel injection valve receiving passage in which there is inserted a respective fuel injection valve 10 as shown in FIGS. 1 to 4 and described further above.

The injection valves 10 are fastened to the cylinder head 42 by means of clamping screws 40".

By way of their port part 20 or port body 20', the injection valves 10 project beyond the cylinder head 42, and the high-pressure ports 22, 24 are situated on the port plane 30 that faces away from the cylinder head 42, and are thus freely accessible.

A first high-pressure fuel line 164 forms a fuel high-pressure feed line and is connected at one side to a high-pressure delivery pump 166 and at the other side to the first high-pressure port 22 of a first injection valve 10 of the series of injection valves.

A second high-pressure fuel line 164' is connected to the second high-pressure port 24 of said fuel injection valve 10, which second high-pressure fuel line is connected at the other side to the first high-pressure port 22 of the immediately subsequent fuel injection valve 10.

FIGS. 5 and 6 show a further second high-pressure fuel line 164' which connects the second high-pressure port 24 of the second fuel injection valve 10 to the first high-pressure port 22 of an immediately subsequent fuel injection valve 10 (not shown).

The second high-pressure fuel lines form fuel high-pressure connecting lines.

In the case of the last of the series of injection valves 130, the second high-pressure port 24 is closed off by means of a plug.

FIG. 6 shows the same arrangement of fuel injection valves 10 and high-pressure fuel lines 164, 164' as FIG. 5, but without the cylinder head 42.

It is preferably the case, as in the exemplary embodiment shown, that the longitudinal axes 14 of the fuel injection valves 10 of the series of fuel injection valves 10, and also the port axes 22', 24' of the high-pressure ports 22, 24 thereof, lie in the common plane 26.

Furthermore, in the exemplary embodiment shown, the central lines 168 of the second high-pressure fuel lines 164', which form fuel high-pressure connecting lines, likewise lie in the same plane 26. In the exemplary embodiment shown, this also applies to the first high-pressure fuel line 164.

The port planes 30 of all of the interconnected fuel injection valves 10 likewise lie in one plane.

The advantage of this arrangement lies in the fact that the second high-pressure fuel lines 164', and in the present case also the first high-pressure fuel line 164, need merely have in each case two 90° bends situated in the plane 26, and can be mounted and dismounted in a simple manner.

Figure 8:
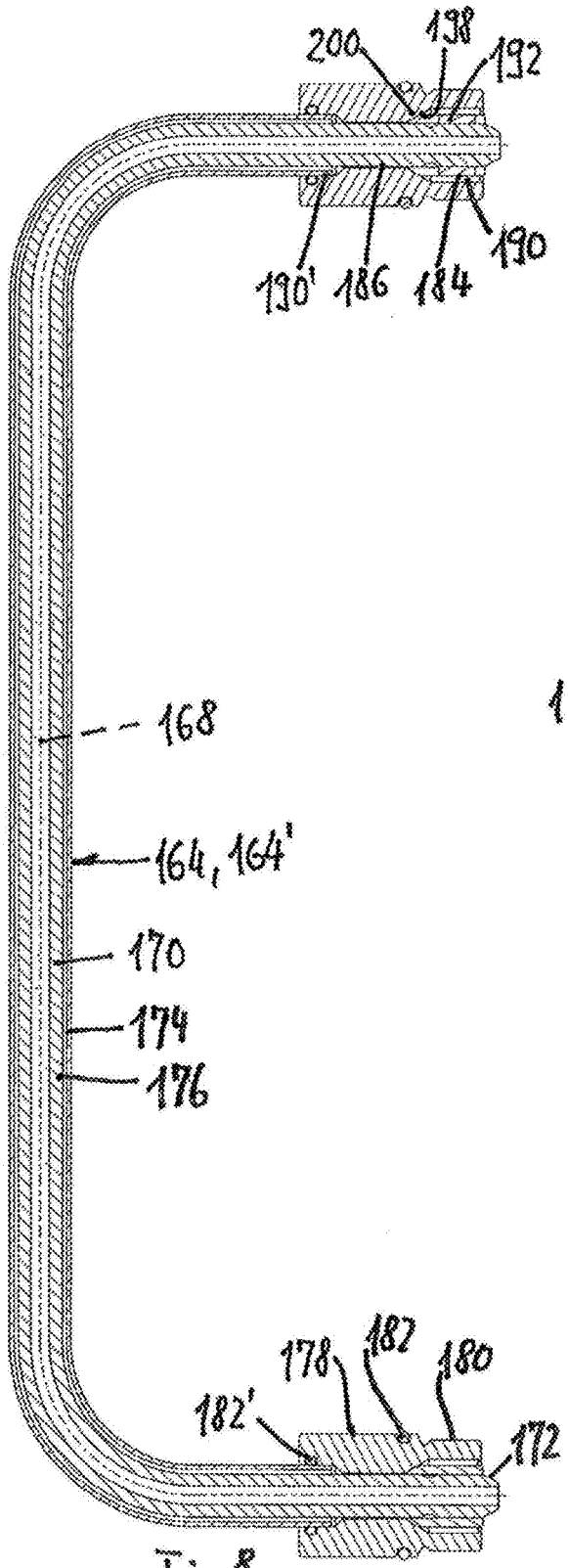
FIG. 8 shows, in a section along the line VIII-VIII in FIG. 7, the high-pressure fuel line shown in said figure.
Figure 7:
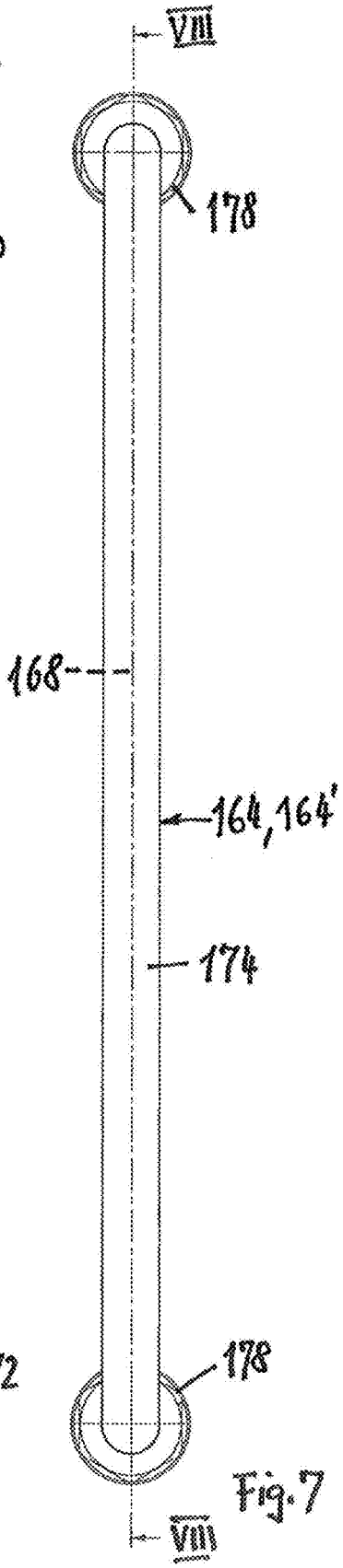
FIG. 7 shows a high-pressure fuel line in a plan view.

In the present exemplary embodiment for the purpose of monitoring any leakage, the high-pressure fuel lines 164, 164' are of double-walled form, as can be seen from FIGS. 7 and 8. An inner pipe 170 is designed for conducting the very highly pressurized fuel. Said inner pipe has, at both ends, a high-pressure sealing surface 172 which tapers conically toward the free end and which is situated on the outside as viewed in the radial direction and which is designed such that, in the installed state, it interacts with the high-pressure sealing surface 66 of the respective high-pressure port 22, 24.

The inner pipe 170 runs within a (thin-walled) outer pipe 174, wherein a leakage return gap 176 exists between the outer pipe 174 and the inner pipe 170.

Figure 10:
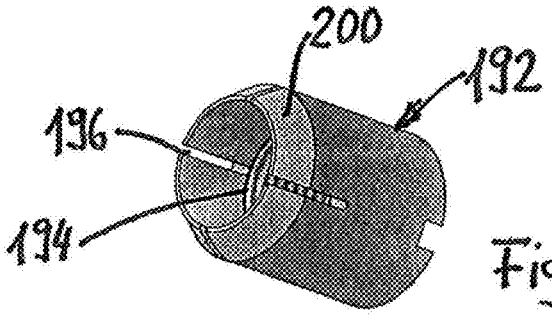
FIG. 10 shows, in a perspective illustration, a fastening sleeve for the high-pressure fuel lines.
Figure 9:
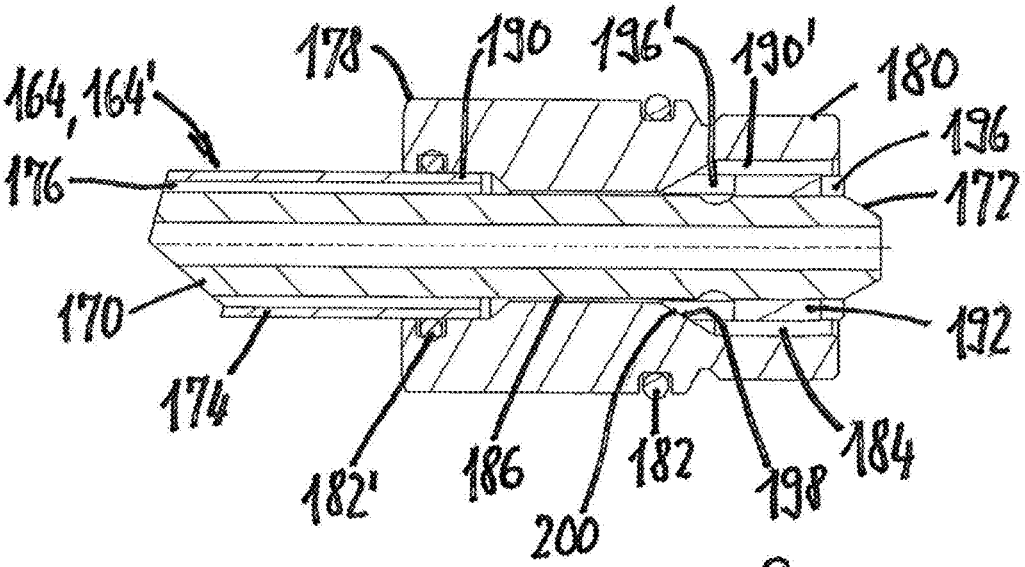
FIG. 9 shows a connection section of the high-pressure fuel lines shown in FIGS. 5 to 8.

At their two ends, the high-pressure fuel lines 164, 164' have a connecting nut 178; in this regard, reference is also made to FIGS. 9 and 10.

The connecting nut 178 is provided, in an end region facing toward the free end of the high-pressure fuel line 164, 164', with an external thread 180 which is designed to be screwed into the internal thread 62' of the second section 62 of the respective high-pressure port 22, 24.

Furthermore, the connecting nut 178 has a circumferential groove which is open to the outside as viewed in a radial direction and into which there is inserted an O-ring 182 which, in the installed state, interacts with the sealing surface 60' in the first section 60 of the respective high-pressure port 22, 24 in order to seal off the interior of the recess 58 with respect to the environment.

Furthermore, the connecting nut 178 has a nut passage 184 which runs in the axial direction through said connecting nut and through which the inner pipe 170 runs so as to form a gap 186. The nut passage 184 is formed so as to be of relatively large diameter in its end regions at both sides. The outer pipe 174 engages into the first end region 190 facing away from the external thread 180, against the outer side of which outer pipe a further O-ring 182' bears sealingly, which O-ring is received at the other side in an inner circumferential groove in the connecting nut 178.

A fastening sleeve 192, the construction of which can be seen particularly clearly in FIG. 10, is arranged in the second end region 190' which faces toward the free end of the high-pressure fuel line 64, 64'. Said fastening sleeve has, in a central section as viewed in the axial direction, an internal thread 194 by means of which said fastening sleeve is screwed onto a corresponding external thread of the inner pipe 170. In its end region facing away from the free end of the high-pressure fuel line 164, 164', the fastening sleeve 194 has four groove-like leakage recesses 196 which are situated opposite one another in crosswise configuration and which are continuous in the radial direction. Here, the fastening sleeve 192 is provided, on the outside, with a conical taper 198 which interacts with a corresponding conical support surface 200 on the nut passage 184.

In the installed state, the high-pressure sealing surface 172 of the inner pipe 170 is held in sealing abutment against the high-pressure sealing surface 66 of the respective high-pressure port 22, 24 by means of the connecting nut 178 via the fastening sleeve 192. If the seal formed by the two sealing surfaces 66 and 172 leaks, the leakage fuel can pass through the leakage recesses 196 into the gap 186 that is delimited radially to the outside by the connecting nut 178. Said gap is connected in terms of flow to the leakage return gap 176 between the inner pipe 170 and the outer pipe 174. If the inner pipe 170 itself leaks, the respective leakage fuel is also captured in the outer pipe 174.

Furthermore, in the port parts 20, the gaps 186 and thus the leakage return gaps 176 of the high-pressure fuel lines 164, 164' are connected in terms of flow to one another by means of the oblique leakage bores 182. The longitudinal leakage bore 80 also leads into said connection, whereby any leakage of fuel can be identified in a simple manner. A single leakage sensor, which is preferably arranged at the beginning or at the end of the line system, is thus sufficient for monitoring the entire device with regard to leakage.

In a known manner, the fuel injection valves 10 are actuated in succession in a predefined sequence for an injection of very highly pressurized fuel. In the rest state, the pilot valve 180 is in the closed position and the intermediate valve 145 is in the open position, and the injection valve element 126 bears sealingly against the injection valve 130.

To initiate an injection process, the actuator arrangement 112 of the respective fuel injection valve is electrically excited, whereby the pilot valve element 122 is opened up. Owing to the high pressure prevailing in the valve chamber 150, the pilot valve element 122 is raised out of its position of abutment against the further intermediate plate 154, as a result of which fuel flows out of the valve chamber 150 into the low-pressure fuel return line 123. As a result of the pressure difference thus generated between the pressure in the control chamber 142 and in the valve chamber 150, the intermediate valve 145 is closed such that no follow-up flow of highly pressurized fuel from the high-pressure chamber 16 into the control chamber 142 is possible. As a result of the flow of fuel out of the control chamber through the throttle bore 96 into the valve chamber, the pressure in the control chamber 142 falls, which leads to the injection valve element 126 being raised from the injection valve seat 130. As a result, highly pressurized fuel is injected through the nozzle openings 132 into the combustion chamber.

To end the injection process, the excitation of the actuator arrangement 112 is ended, which leads to a closure of the pilot valve 118. As a result, the pressure in the valve chamber 150 rises by virtue of the fact that fuel can flow in from the control chamber 142 through the throttle bore 96. Said pressure increase has the result that the intermediate valve 145 opens and permits the follow-up flow of highly pressurized fuel from the high-pressure chamber 16 into the control chamber 142. This leads to a rapid pressure increase in the control chamber 142, which causes the injection valve element 162 to be moved onto the injection valve seat 130, thus ending the injection process.

During the injection process, the pressure in the high-pressure chamber 16 falls. Owing to the discrete accumulator chambers 84 and the check valve 90 that is provided with the throttle bore 96, it is now possible, during an injection process, for a follow-up flow of fuel to take place from the high-pressure delivery pump 166, from the high-pressure fuel lines 164, 164' and from further fuel injection valves 10 into the fuel injection valve 10 performing the injection. This ensures optimum injection processes with relatively small discrete accumulator chambers 46 and thus with fuel injection valves 10 that take up little space, without the provision of a large accumulator chamber in the form of a "common rail".

By contrast to the embodiment shown in FIGS. 2, 3, 5 and 6, the high-pressure ports 22, 24 may also be arranged such that their port axes 22', 24' enclose an angle of 90°, or an angle of between 0° and 90°, with a longitudinal direction defined by the longitudinal axis 14.

The invention claimed is:

1. A fuel injection valve for the intermittent injection of fuel into the combustion chamber of an internal combustion engine, having a valve housing which comprises a high-pressure chamber with a discrete accumulator chamber and defines a longitudinal axis and which, at one side, bears a nozzle body connected to the high-pressure chamber and, at an opposite side, has a port part with two high-pressure ports for high-pressure fuel lines, which high-pressure ports define in each case a port axis and are connected to the high-pressure chamber and in unthrottled fashion to one another, and the high-pressure ports are arranged in a common port surface of the port part so as to be oriented in the same direction and such that their port axes run parallel, each of the two high-pressure ports has a conically tapering high-pressure sealing surface proceeding from a base of the respective high-pressure port, the axis of which high-pressure sealing surface coincides with the respective port axis, wherein a longitudinal bore runs, concentrically with respect to the port axis and the longitudinal axis, from the high-pressure sealing surface of the first high-pressure port through a port body forming the port part to the face side, facing away from the high-pressure ports, a blind bore runs from the high-pressure sealing surface of the second high-pressure port in the direction of its port axis, which blind bore opens into a transverse bore, which in turn opens into the longitudinal bore, the longitudinal bore opens into the discrete accumulator chamber and the longitudinal bore, the blind bore and the transverse bore form a connecting line.

2. The fuel injection valve as claimed in claim 1, wherein a throttle device permits the flow of the fuel from the high-pressure ports into the discrete accumulator chamber in unhindered fashion and throttles said flow in the opposite direction.

3. The fuel injection valve as claimed in claim 2, wherein the throttle device is in the form of a check valve, and the check valve element is provided with a throttle bore.

4. A fuel injection valve as claimed in claim 2, wherein a circular cylindrical accumulator body bears against that face side of the port body, which faces away from the high-pressure ports, said accumulator body being held in sealing abutment by means of a first cap nut against the port body, the accumulator body has a blind bore which is manufactured proceeding from that face side which faces toward the port body in the assembled state, which blind bore has a diameter that is larger in relation to the cross section of the connecting line, the blind bore serves for forming the discrete accumulator chamber for the highly pressurized fuel, a connecting bore runs, obliquely with respect to the longitudinal axis, to the base of the accumulator chamber from that face side of the accumulator body which faces away from the port body, the blind bore has a larger diameter in an end section facing toward the port body for the purpose of forming a shoulder for supporting a valve carrier of the check valve, a check valve seat is formed by an annular part, running around the opening of the connecting line, of that face side of the port body which faces toward the accumulator body, and a check valve body which is of plate-shaped form and forms a check valve element interacts with the check valve seat, which check valve body has the continuous throttle bore centrally, on the longitudinal axis.

5. The fuel injection valve as claimed in claim 1, wherein the port surface is a port plane.

6. The fuel injection valve as claimed in claim 5, wherein the port plane runs perpendicular to the longitudinal axis.

7. The fuel injection valve as claimed in claim 1, wherein the high-pressure ports are of identical design.

8. The fuel injection valve as claimed in claim 1, wherein the high-pressure ports have, in the center, the conical port sealing surface for the high-pressure fuel lines and have, outside the port sealing surfaces as viewed in the radial direction, leakage monitoring openings that are connected to one another.

9. The fuel injection valve as claimed in claim 1, wherein the nozzle body has an injection valve seat which is connected to the high-pressure chamber and with which there interacts an injection valve element that is arranged in the valve housing so as to be adjustable in the direction of the longitudinal axis, a compression spring is supported at one side on the injection valve element and exerts on the latter a closing force directed toward the injection valve seat and is supported at the other side on a guide sleeve and presses the guide sleeve sealingly against an intermediate plate, the guide sleeve together with a control piston, guided in said guide sleeve, of the injection valve element delimits a control chamber with respect to the high-pressure chamber, a control device for controlling the axial movement of the injection valve element by varying the pressure in the control chamber has an intermediate valve whose intermediate valve element, when in an open position, opens up a high-pressure passage, connected to the high-pressure chamber, into the control chamber and, when in a closed position, separates the control chamber from the high-pressure passage and, permanently, separates the control chamber from a valve chamber aside from a throttle passage, and the valve chamber is connected to and separated from a low-pressure fuel return line by means of an electrically actuated actuator arrangement.

10. The fuel injection valve as claimed in claim 9, wherein a low-pressure fuel return port and an electrical terminal connected to the actuator arrangement are arranged on the port body, an intermediate body, in which the actuator arrangement is arranged, of the valve housing bears against the accumulator body, and a valve body of the valve housing bears against the intermediate body, which valve body, on the other side, bears the nozzle body and in which valve body the injection valve element and the control device are arranged.

11. A device for the intermittent injection of fuel into a number of combustion chambers of an internal combustion engine, having a fuel injection valve as claimed in claim 1 for each combustion chamber, wherein the fuel injection valves are of structurally identical form, a first high-pressure fuel line —a fuel high-pressure feed line—is connected to a first of the two high-pressure ports of a first of the fuel injection valves, which first high-pressure fuel line, for feeding fuel to the fuel injection valves, is connected at the other side to a high-pressure delivery pump, and a second high-pressure fuel line—a fuel high-pressure connecting line—is connected to in each case the second of the two high-pressure ports of the fuel injection valves, which second high-pressure fuel line is connected at the other side to a first high-pressure port of a respectively subsequent fuel injection valve, wherein, however, in the case of the last of the fuel injection valves, the second high-pressure port is closed off by means of a plug, and wherein the fuel injection valves are connected to one another in unthrottled fashion.

12. The device as claimed in claim 11, wherein the second high-pressure fuel line or all of the second high-pressure fuel lines, has or have bends situated in a single plane.

13. The device as claimed in claim 12, wherein the longitudinal axes of the fuel injection valves and the port axes thereof lie in the same plane as the second high-pressure fuel lines.

14. The device as claimed in claim 11, wherein the second high-pressure fuel lines lie in a single plane.

15. The device as claimed in claim 14, wherein the longitudinal axes of the fuel injection valves and the port axes thereof lie in the same plane as the second high-pressure fuel lines.

16. The device as claimed in claim 11, wherein the longitudinal axes of the fuel injection valves and the port axes thereof lie in the same plane as the second high-pressure fuel lines.

17. The device as claimed in claim 11, wherein the fuel injection valves are connected to high-pressure delivery pump in unthrottled fashion.

18. The fuel injection valve as claimed in claim 17, wherein the check valve body is subjected to a closing force directed toward a closed position of the check valve by a closing spring which is in the form of a compression spring and which is supported at the other end on the valve carrier.

19. The fuel injection valve as claimed in claim 18, wherein a passage of the same cross section as the connecting line runs centrally through the valve carrier and the valve carrier closes off the accumulator chamber in the axial direction toward the port body.

* * * * *